446-222
10/15/85 OR 4,547,168

United States Patent [19]
Blacksberg et al.

[11] Patent Number: 4,547,168
[45] Date of Patent: Oct. 15, 1985

[54] INFLATABLE ASSEMBLY WITH SURFACE CLOSURE

[75] Inventors: Richard Blacksberg; Michael S. Isaacs, both of Brooklyn, N.Y.

[73] Assignee: U.S. Balloon Mfg. Co., Inc., Brooklyn, N.Y.

[21] Appl. No.: 505,989

[22] Filed: Jun. 20, 1983

[51] Int. Cl.[4] ..... A63H 3/06
[52] U.S. Cl. ..... 446/222
[58] Field of Search ..... 46/87, 90; 244/24; 152/367; 248/205 A; 446/220, 222, 224, 225, 226; 53/403

[56] References Cited

U.S. PATENT DOCUMENTS

| | | | |
|---|---|---|---|
| 2,674,064 | 4/1954 | Gassaway | 46/90 |
| 3,088,242 | 5/1963 | Rockovits | 46/90 |
| 3,108,396 | 10/1963 | Dorman | 46/90 |
| 3,230,663 | 1/1966 | Shabram | 46/90 |
| 3,837,608 | 9/1974 | Simon | 248/205 A |
| 4,263,682 | 4/1981 | Bejarano | 46/90 |

*Primary Examiner*—Robert A. Hafer
*Assistant Examiner*—Daniel Nolan

[57] ABSTRACT

An inflatable assembly is formed of two superimposed sheets sealed at the peripheries thereof to form a generally closed gas receiving compartment having an external surface and an aperture in that surface for receiving a conduit during inflation. An adhesive pad or strip is provided which covers the aperture and is at least partially attached to the external surface about the aperture with the exception of a zone of initial separation for providing access for the gas conduit into the aperture. The adhesive pad includes adhesive in the region of zone of initial separation in which there is interposed a strip of slip paper which resists adhesion between the pad and the external surface in the zone of initial separation. After inflation, removal of the strip of slip paper allows full closure of the aperture by adhesion between the adhesive pad and the external surface in the zone of initial separation.

12 Claims, 4 Drawing Figures

FIG. 1
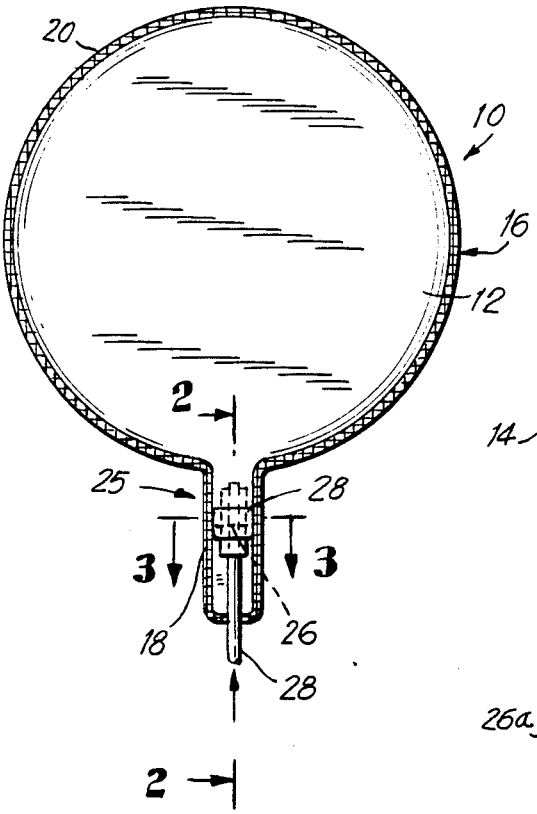
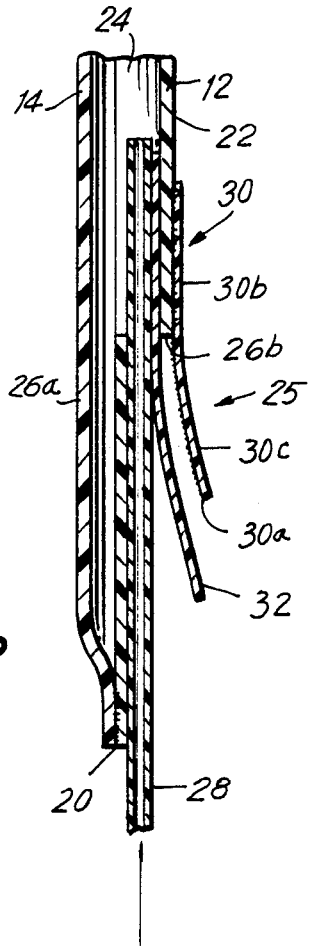
FIG. 2
FIG. 4
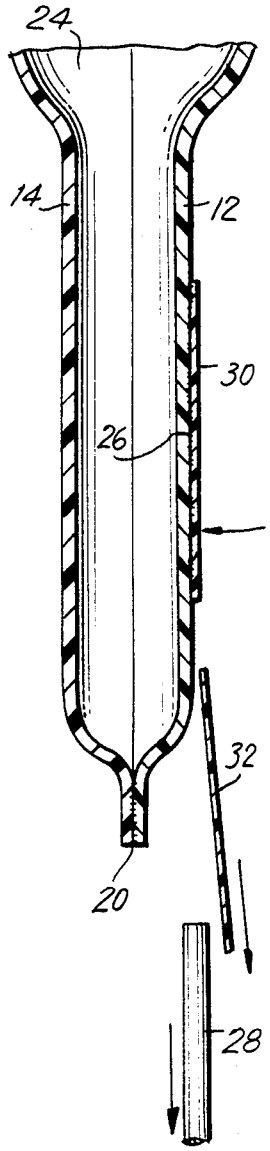
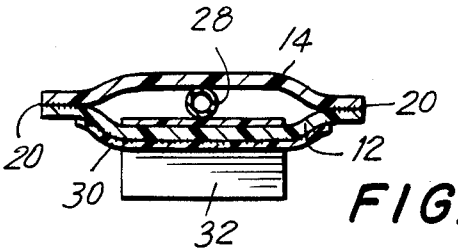
FIG. 3

INFLATABLE ASSEMBLY WITH SURFACE CLOSURE

BACKGROUND OF THE INVENTION

Toy inflatable balloons have traditionally been made of rubber. Balloons made of Mylar and other sheet materials, usually metalized, have been introduced which are less pervious to gas losses and can retain helium, for example, for several days. Sealing the openings through which the ballons are inflated has, however, presented a problem.

One attempt at sealing balloons of sheet material has been to twist the ends or neck portions thereof following inflation and tying the twisted ends with a string. This approach has not, however, proved satisfactory since excessive losses of gas have taken place through the twisted and tied ends.

Spring clips have also been used in an effort to seal off the open ends of foil-type balloons. These clips are typically applied to the twisted ends of the balloons to pinch or squeeze the twisted ends thereby to halt escape of gas. However, irrespective of the biasing forces applied to the twisted ends by the spring clips, minute channels have remained through which gases can gradually escape.

A number of plugs have been proposed for sealing the openings through which film balloons are inflated. Some of these plugs are generally tapered and are intended to be simply forced into suitable valve openings following inflation. Reliance on force fits, however, have not proved satisfactory because of the difficulty of manufacturing processes in providing sufficiently close tolerances. Other plugs have been more elaborate. In all cases, however, such plugs have tended to be too complex, too expensive and too heavy to be practical.

Another approach has been to heat seal the open ends subsequent to inflation. While such sealing has reduced the amount of gas leakage, it has been inconvenient to use and has required heat sealing equipment which must be connected to power lines thereby reducing its mobility. Also, the heat seals produced have not been consistently satisfactory, particulary when made by inexperienced operators.

SUMMARY OF THE INVENTION

Accordingly, it is an object of the invention to provide an inflatable assembly which eliminates the disadvantages inherent in the existing assemblies.

It is another object of the present invention to provide an inflatable assembly which has a closure which is simple in construction and economical to manufacture.

It is still another object of the present invention to provide an inflatable assembly which can be sealed with minimal dexterity and loss of gas.

It is yet another object of the present invention to provide an inflatable assembly having a closure which is reliable and which minimizes gas leakages.

Other objects and advantages of the present invention will become apparent from the disclosure that follows.

In accordance with the invention, an inflatable assembly comprises a device formed of sheet material having a surface defining a generally closed gas receiving compartment and having an aperture in said surface for receiving a conduit associated with a source of gas. Closure means are provided which are mounted on said surface covering said aperture and being sealingly attached to said surface about said aperture with the exception of the zone of initial separation dimensioned to provide the gas conduit with access to said aperture. Said closure means is provided with adhesive means on the surface of said zone facing said sheet material surface and said aperture. Separator means are provided disposed between said zone of said closure means and said sheet material surface to prevent premature attachment therebetween. Said separator means is adapted to be removed thereby exposing said adhesive means to said sheet material surface. In this way, removal of said separator means subsequent to inflation of said inflatable device and application of pressure to said closure means in the region of said zone of initial separation seals said aperture to prevent escape of gas therethrough.

BRIEF DESCRIPTION OF THE DRAWINGS

A better understanding of the present invention may be had from a consideration of the following detailed description, taken in conjunction with the accompanying drawings, in which:

FIG. 1 is a top plan view of an inflatable assembly with a surface closure in accordance with the present invention, showing the manner in which gas supply conduit extends into the assembly during inflation;

FIG. 2 is a cross-sectional view of the inflatable assembly and the surface closure shown in FIG. 1, taken along line 2—2;

FIG. 3 is a cross-sectional view taken through the inflatable assembly and surface closure shown in FIG. 1, taken along line 3—3; and FIG. 4 is similar to FIG. 2, showing the manner in which the surface closure operates to seal the aperture in the surface of the inflatable assembly subsequent to inflation.

DETAILED DESCRIPTION OF THE DRAWINGS

Referring now specifically to the figures, in which identical or similar parts are designated by the same reference numerals throughout, an inflatable assembly in accordance with the present invention is generally designated by the reference numeral 10.

The inflatable assembly 10 comprises a front or top sheet 12 in a rear or back sheet 14 which define an inflatable device having a main body portion 16 and a neck portion 18. The main body portion 16 is shown circular, although any desired shapes can be used. The front and rear sheets 12, 14 are similarly shaped and superimposed as shown, a heat seal 20 being provided about the periphery of the sheets of material to form a surface 22 which defines a generally closed gas receiving compartment 24. While the closed compartment in this instance has been formed by two separate sheets of material requiring heat sealing about their entire peripheries, it will also be clear that it is possible to utilize a single sheet material folded over to thereby require heat sealing only about portions of the periphery. Also any other suitable and conventional sealing means may be used.

A surface closure valve assembly is generally designated by the reference numeral 25 in FIG. 1 and comprises an aperture in the nature of a slit 26 provided in the neck portion 18 of the front sheet 12. Since the front and rear sheets 12, 14 are similar in every respect, it will become clear that the valve assembly 25 can as easily be provided on the rear or opposite sheet of the assembly.

Referring to FIG. 2, the details of the valve assembly 25 are shown during inflation. The closure valve assembly 25 includes a sealing tape, pad or tab 30 to which there is applied an adhesive 30*a* on the surface thereof facing the inflatable assembly. To facilitate the description, the tab 30 is shown to include an upper portion 30*b* extending above the cut lines 26*a* and 26*b* of the aperture 26 and a lower portion 30*c* extending below the cut lines. The upper portion 30*b* of the tab 30 is sealingly attached to the surface 22 about the aperture 26 with the exception of a zone of initial separation which, in the embodiment being described, is that part of the tab 30 below the cut lines 26*a*, 26*b* identified by the references numeral 30*c*. The zone of initial separation is dimensioned to provide the gas conduit 28 with access to the aperture 26. It will be evident from FIG. 2 that the tab 30 is provided with adhesive 30*a* on the surface of the zone of initial separation which faces the front sheet 12 and the aperture 26.

In order to prevent premature attachment of the tab portion 30*c* to the front sheet 12 below the aperture 26, a separator or protective strip in the nature of slip paper 32 is provided and disposed between the tab portion 30*c* and the sheet material surface 22. The strip 32 may be made of any material which is surface treated with a material, which is resistent to the adhesive 30*a*, such as silicone. The strip 32 is adapted to be removed thereby exposing the adhesive 30*a* to the sheet material surface 22 below the cut lines 26*a*, 26*b*. In this manner, removal of the slip paper or separator strip subsequent to inflation of the inflatable assembly and application of finger pressure to the tab 30 in the region of the zone 30*c* seals the aperture 26 to prevent escape of gas therethrough. Referring to FIG. 4, there is shown the inflatable assembly, following inflation and sealing of the aperture 26.

The method of inflating and sealing the assembly in accordance with the invention is extremely simple. Referring to FIGS. 2 and 4, the inflator tube or conduit 28 is inserted through the aperture 26, with the slip paper 32 preventing premature adhesion of the adhesive tap portion 30*c* to the front sheet surface 22. Following inflation, the tube or conduit 28 is withdrawn and, substantially simultaneously, the slip paper or separator 32 is likewise withdrawn thereby exposing the adhesive 30*a* to the surface 22 of the front sheet 12. Application of finger pressure on the lower part of the tab portion 30*c*, as suggested by the arrow in FIG. 4, seals the aperture 26 and prevents escape of gas therethrough.

The top and rear sheets 12, 14 may be made of any suitable material typically used in the manufacture of balloons. In the presently preferred embodiments described the sheets 12, 14 may be made of foil, metalized fabric or nylon, vinyl or sheet materials, polymers, polypropylene, etc.

Although there has been described a presently preferred embodiment in accordance with the invention for the purposes of illustrating the manner in which the invention may be used, it will be appreciated that the invention is not limited thereto. Accordingly, any and all modifications, variations or equivalent arrangements which come within the scope of the appended claims should be considered to be a part of the invention.

Thus, materials used to manufacture balloons have a wide range of thicknesses. Extremely thin materials may wrinkle and produces creases and undesirable passageways which will act as conduits allowing slow leakage of the gas introduced into the balloon. With such thin materials, it may be necessary to affix a reinforcing section of thicker, more rigid material between the front sheet 12 of the neck portion 18 and the pad 30, which is also provided with an aperture which registers or is aligned with the aperture 26. Advantageously the reinforcing section is larger than the pad 30 so that it serves as an effective flat, rigid base for the pad 30 to thereby assure optimum sealing.

What is claimed is:

1. An inflatable assembly comprising:

a. A device formed of sheet material having an external surface defining a generally closed gas receiving compartment and having an aperture in said surface for receiving a conduit associated with a source of gas;

b. closure means mounted on said external surface covering said aperture and being sealingly attached to said surface about said aperture with the exception of a zone of initial separation dimensioned to provide the gas conduit with access to said aperture, said closure means being provided with adhesive means on the surface of said zone facing said sheet material surface and said aperture; and c. separator means disposed between said zone of said closure means and said sheet material surface to prevent premature attachment therebetween, said separator means being adapted to be removed thereby exposing said adhesive means to said sheet material surface, whereby removal of said separator means subsequent to inflation of said inflatable device and application of pressure to said closure means in the region of said zone of initial separation seals said aperture to prevent escape of gas therethrough.

2. An inflatable assembly as defined in claim 1, wherein said device comprises superimposed front and rear sheets of material sealed about the entire peripheries thereof.

3. An inflatable assembly as defined in claim 2, wherein said sheets of material each include a main body portion and a neck portion.

4. An inflatable assembly as defined in claim 3, wherein said aperture is provided in said neck portion of said front sheet of material.

5. An inflatable assembly as defined in claim 1, wherein said closure means comprises a pad and said adhesive means comprise adhesive applied to said pad on the surface thereof facing said sheet material surfaces.

6. An inflatable assembly as defined in claim 1, wherein said separator means comprises a strip of slip paper which resists adhesion to said adhesive means.

7. An inflatable assembly as defined in claim 6, wherein said strip of slip paper has one end thereof extending through said aperture and into said gas compartment and the other end thereof extends beyond said closure means.

8. An inflatable assembly as defined in claim 1, wherein said sheet material comprises a plastic film.

9. An inflatable assembly as defined in claim 1, wherein said sheet material comprises a metal foil.

10. An inflatable assembly as defined in claim 1, wherein said sheet material comprises metalized fabric.

11. An inflatable assembly as defined in claim 1, wherein said device is a balloon.

12. An inflatable assembly as defined in claim 1, wherein said separator means comprises a strip of material treated with silicone.

* * * * *